US008816654B2

(12) United States Patent
Kletti et al.

(10) Patent No.: US 8,816,654 B2
(45) Date of Patent: Aug. 26, 2014

(54) UNIVERSAL-VOLTAGE DISCRETE INPUT CIRCUIT

(75) Inventors: Daniel Rian Kletti, Oak Creek, WI (US); Timothy Mark Kromrey, Milwaukee, WA (US)

(73) Assignee: Cooper Technologies Company, Houston, TX (US)

( * ) Notice: Subject to any disclaimer, the term of this patent is extended or adjusted under 35 U.S.C. 154(b) by 369 days.

(21) Appl. No.: 13/213,625

(22) Filed: Aug. 19, 2011

(65) Prior Publication Data

US 2012/0075895 A1 Mar. 29, 2012

Related U.S. Application Data

(60) Provisional application No. 61/386,834, filed on Sep. 27, 2010.

(51) Int. Cl.
*G05F 3/16* (2006.01)

(52) U.S. Cl.
USPC ..... 323/225

(58) Field of Classification Search
CPC ..... G05F 3/18; H02M 7/06; H03D 13/004
USPC ..... 323/223–225, 268, 271, 282, 299; 363/125, 126; 327/376, 377, 389, 399
See application file for complete search history.

(56) References Cited

U.S. PATENT DOCUMENTS

| | | | | |
|---|---|---|---|---|
| 5,023,767 | A | 6/1991 | Lopez et al. | |
| 5,400,203 | A | 3/1995 | Tice | |
| 5,568,398 | A | 10/1996 | Trainor | |
| 5,592,071 | A | 1/1997 | Brown | |
| 5,689,179 | A | 11/1997 | Walker | |
| 5,909,660 | A | 6/1999 | Foote | |
| 6,211,661 | B1 | 4/2001 | Eckhardt | |
| 7,023,005 | B2 | 4/2006 | Williams et al. | |
| 7,161,338 | B2 | 1/2007 | Jiang et al. | |
| 7,459,941 | B2 * | 12/2008 | Li | 327/77 |
| 7,504,878 | B2 | 3/2009 | Lin | |
| 7,715,216 | B2 | 5/2010 | Liu et al. | |
| 2010/0239303 | A1 * | 9/2010 | Matsumoto | 399/88 |
| 2010/0321070 | A1 * | 12/2010 | Matsumoto | 327/109 |
| 2013/0236206 | A1 * | 9/2013 | Shoji et al. | 399/88 |

OTHER PUBLICATIONS

International Search Report and Written Opinion for corresponding international PCT application serial No. PCT/US2011/048713, mailed Dec. 15, 2011 (11 pages).

* cited by examiner

*Primary Examiner* — Matthew Nguyen
(74) *Attorney, Agent, or Firm* — King & Spalding LLP

(57) ABSTRACT

A universal-voltage discrete input circuit uses a high voltage depletion-mode field effect transistor in combination with a low-voltage, adjustable precision shunt regulator and an isolation circuit for interfacing a low voltage digital logic circuit to a switched external voltage ranging from about 7 volts to about 1000 volts AC or +/− DC, at a low fixed current. In addition to the wide input voltage range accepted at a uniform low current value, very high voltage isolation is provided between the external voltage and the low voltage digital logic circuit, and elimination of ground loops and common mode noise.

20 Claims, 4 Drawing Sheets

UNIVERSAL-VOLTAGE DISCRETE INPUT CIRCUIT

RELATED PATENT APPLICATION

This application claims priority to commonly owned U.S. Provisional Patent Application Ser. No. 61/386,834; filed Sep. 27, 2010; entitled "Universal-Voltage Discrete Input Circuit," by Daniel Rian Kletti and Timothy Mark Kromrey; and is hereby incorporated by reference herein for all purposes.

TECHNICAL FIELD

The present invention relates generally to voltage input circuits for coupling to digital logic circuits, and more particularly, to a universal-voltage discrete input circuit capable of accepting a wide range of input voltages while drawing a low value of current.

BACKGROUND

Previous designs for discrete voltage input circuits were only capable of accepting inputs over a specific narrow range of voltage levels, and were inaccurate and unreliable over a desired operating temperature range. A different circuit configuration was required for each specific narrow range of voltage levels, and/or jumpers, switches, firmware, etc., was required to reconfigure the input circuit to meet the application voltage requirement.

Referring to FIG. 1, depicted is a schematic diagram of a prior art voltage input circuit for coupling to a digital logic circuit. The circuit shown in FIG. 1 allows a narrow range of input voltages to safely drive a logic input of a digital circuit. A input voltage is applied to a series connected first current limiting resistor 102 and zener diode 104. The zener diode 104 is selected to limit a second voltage to a series connected second current limiting resistor 106 and an input light emitting diode (LED) of an optocoupler 108.

For example, if the zener conduction voltage of the zener diode 104 is selected to be 5.7 volts and a current of 5 milliamperes (ma.) is desired to flow through the LED portion of the isolation circuit 108, a resistance value for the second current limiting resistor 106 may be calculated as follows: R106=(5.7 volts−0.7 volts)/5 ma, resulting in a resistance value of 1000 ohms for the second current limiting resistor 106. The input voltage must be greater than 5.7 volts for the zener diode to provide the full 5.7 volts to the second current limiting resistor 106, less input voltage than that will reduce the current through the LED of the optocoupler 108. When the current through the LED of the isolation circuit 108 is reduced significantly, the optocoupler 108 becomes unreliable in transferring the presence of an input voltage to the logic circuit.

As the input voltage increases, the current through the first current limiting resistor 102 and zener diode 104 will correspondingly increase. This is not desirable since the wattage of both the zener diode 104 and the first current limiting resistor 102 must be sized for a worst case maximum input voltage. Also the current load presented to the source of the input voltage increases. For example, at an input voltage of 10.7 volts and a current through the first current limiting resistor 102 of 10 ma., the resistance necessary for the first current limiting resistor will be 500 ohms. If the input voltage is at 105.7 volts, current flowing through the first current limiting resistor 102 will be 200 ma. and the current through the zener 104 will be 195 ma. At this current value, the first current limiting resistor 102 and the zener 104 must be rated to have a power dissipation of at least 20 watts. Also the input voltage source must be capable of supplying a 20 watt load. This is highly undesirable and therefore limits the range of input voltages that can be safely handled without having to change the value of the first current limiting resistor 102.

Operating temperature variations will also affect the characteristics of the aforementioned components such that proper operation at a low end voltage will vary with temperature. In addition, higher input voltages and operating temperatures may cause one or more of the aforementioned components to malfunction or fail.

SUMMARY

Therefore, what is needed is a voltage input circuit that accepts a much wider range of input voltages without increasing current drawn from the input voltage source, and has more stable thermal operating characteristics over a desired temperature range and over the entire range of input voltages.

According to a specific example embodiment of this disclosure, an apparatus for controlling a low voltage digital circuit with a voltage source having a wide range of voltage values comprises: a depletion-mode field effect transistor (FET) having a drain, gate and source, wherein the drain thereof is adapted for coupling to the voltage source; an adjustable shunt regulator having an anode, cathode and reference input; a resistor network for providing a reference voltage to the reference input of the adjustable shunt regulator, wherein the reference voltage is representative of a current through the resistor network; and an isolation circuit having an isolated input and an isolated output; wherein the isolated input of the isolation circuit is coupled between the source of the depletion-mode FET and the resistor network, the cathode of the adjustable shunt regulator is coupled to the gate of the depletion-mode FET, and the anode of the adjustable shunt regulator and the resistor network are coupled to a common of the voltage source; whereby the adjustable shunt regulator causes the depletion-mode FET to maintain a substantially constant current drawn from the voltage source over a wide range of input voltages therefrom.

According to another specific example embodiment of this disclosure, an apparatus for controlling a low voltage digital circuit with a voltage source having a wide range of voltage values comprises: a full wave bridge rectifier coupled to a voltage source; a depletion-mode field effect transistor (FET) having a drain, gate and source, wherein the drain thereof is adapted for coupling to the full wave bridge rectifier; an adjustable shunt regulator having an anode, cathode and reference input; a resistor network for providing a reference voltage to the reference input of the adjustable shunt regulator, wherein the reference voltage is representative of a current through the resistor network; and an isolation circuit having an isolated input and an isolated output; wherein the isolated input of the isolation circuit is coupled between the source of the depletion-mode FET and the resistor network, the cathode of the adjustable shunt regulator is coupled to the gate of the depletion-mode FET, and the anode of the adjustable shunt regulator and the resistor network are coupled to the full wave bridge rectifier; whereby the adjustable shunt regulator causes the depletion-mode FET to maintain a substantially constant current drawn over a wide range of input voltages from the voltage source.

According to yet another specific example embodiment of this disclosure, a method of controlling a low voltage digital circuit with a voltage source having a wide range of voltage values comprises the steps of: providing a depletion-mode field effect transistor (FET) having a drain, gate and source, wherein the drain thereof is adapted for coupling to the voltage source; providing an adjustable shunt regulator having an anode, cathode and reference input; providing a reference voltage from a resistor network to the reference input of the adjustable shunt regulator, wherein the reference voltage represents a current through the resistor network; and providing an isolation circuit having an isolated input and an isolated output; coupling the isolated input of the isolation circuit between the source of the depletion-mode FET and the resistor network; coupling the cathode of the adjustable shunt regulator to the gate of the depletion-mode FET; coupling the anode of the adjustable shunt regulator and the resistor network to a common of the voltage source; and maintaining a substantially constant current drawn from the voltage source over a wide range of input voltages therefrom by controlling a gate voltage of the depletion-mode FET with the adjustable shunt regulator.

BRIEF DESCRIPTION OF THE DRAWINGS

For a more complete understanding of the present invention and the advantages thereof, reference is now made to the following description, in conjunction with the accompanying drawings briefly described as follows.

Figure 1:
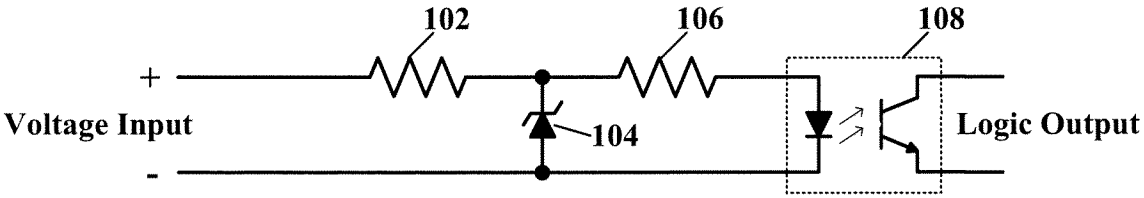
FIGURE 1 (Prior Art)
FIG. 1 illustrates a schematic diagram of a prior art voltage input circuit for coupling to a digital logic circuit.

While the present disclosure is susceptible to various modifications and alternative forms, specific example embodiments thereof have been shown in the drawings and are herein described in detail. It should be understood, however, that the description herein of specific example embodiments is not intended to limit the disclosure to the particular forms disclosed herein, but on the contrary, this disclosure is to cover all modifications and equivalents as defined by the appended claims.

DETAILED DESCRIPTION

Referring now to the drawings, details of example embodiments of the present invention are schematically illustrated. Like elements in the drawings will be represented by like numbers, and similar elements will be represented by like numbers with a different lower case letter suffix.

Figure 2:
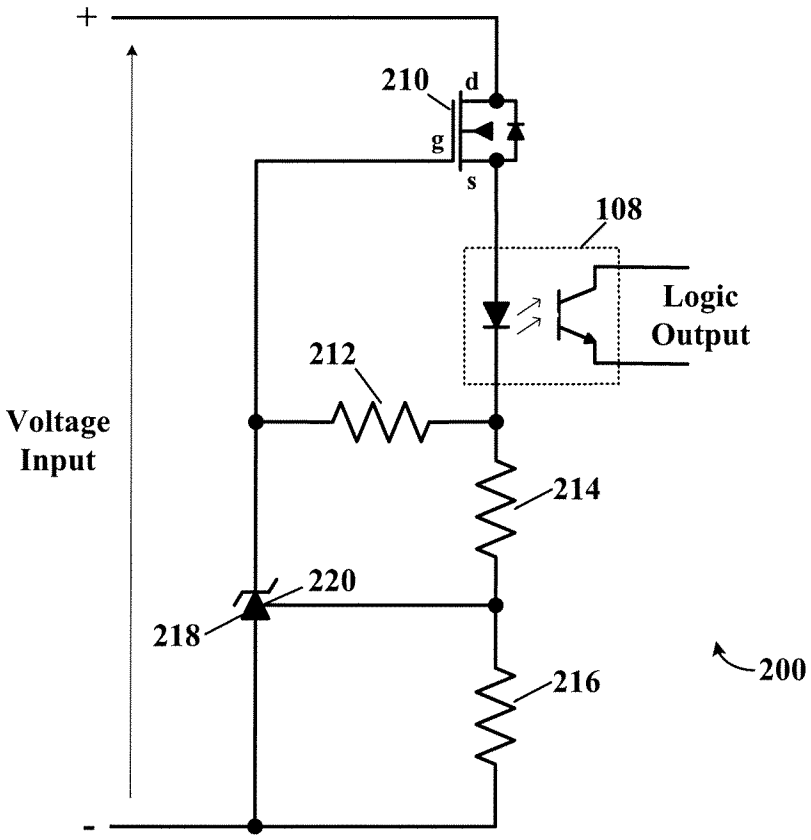
FIG. 2 illustrates a schematic diagram of a universal-voltage discrete input circuit, according to a specific example embodiment of this disclosure.

Referring to FIG. 2, depicted is a schematic diagram of a universal-voltage discrete input circuit, according to a specific example embodiment of this disclosure. The universal-voltage discrete input circuit, generally represented by the numeral 200, comprises a depletion-mode field effect transistor (FET) 210, an isolation circuit 108 (optocoupler shown for illustrative purposes), biasing resistors 212, 214 and 216, and a low-voltage, adjustable precision shunt regulator 218. The depletion-mode FET 210 is designed to allow current to flow even when there is no gate voltage present, therefore, current will flow from the drain to the source without any voltage on the gate, but can be controlled with a negative voltage applied to the gate of the FET 210 referenced to the source thereof (similar to a triode vacuum tube).

The isolation circuit 108 has an isolated input and an isolated output, and may be, for example but is not limited to, an optocoupler having a light emitting diode (LED) for the isolated input and a phototransistor for the isolated output, (e.g., Omron G3VM MOS FET relay, an electromechanical relay having a coil for the isolated input and a contact for the isolated output, a transformer coupled digital isolator (e.g., Analog Devices ADUM1402), etc. When sufficient current flows through the isolated input (e.g., LED portion) of the isolation circuit 108, e.g., from about 1 ma. to about 50 ma., the isolated output (e.g., transistor portion) thereof turns on and can drive a digital logic input circuit or other load to be isolated from the switched input voltage source. Isolation between the isolated input (e.g., LED portion) and the isolated output (e.g., transistor portion) of the isolation circuit 108 is very high, e.g., may be greater than 5000 volts DC.

Series connected resistors 214 and 216 are coupled between an input return of the isolation circuit 108 and a common node of the universal-voltage discrete input circuit 200, and form a voltage divider having a junction therebetween coupled to a reference input 220 of the adjustable precision shunt regulator 218. When current flows through the series connected resistors 214 and 216, a voltage is applied to the reference input 220 of the adjustable precision shunt regulator 218. This voltage may be adjusted by changing the value(s) of either or both of the series connected resistors 214 and 216. The adjustable precision shunt regulator 218 tries to keep a constant voltage across the sense resistor 214 by adjusting the gate voltage of the FET 210. As the gate voltage of the FET 210 is adjusted, the current through the FET 210 (drain to source) changes and the current through the sense resistor 214 changes as well. This action by the adjustable precision shunt regulator 218 provides a substantially constant current through the isolation circuit 108, guaranteeing that sufficient current, but not too much current, is available to turn on the transistor portion of the isolation circuit 108, regardless of input voltage or ambient temperature. In addition, and as an added benefit, input current required from the input voltage source remains at substantially the same current as that which flows through the isolation circuit 108. Resistor 212 is a high resistance value resistor used as a circuit return from the gate to the source of the FET 210 (similar to a grid bias resistor between a grid and a cathode of a vacuum tube triode amplifier).

The adjustable precision shunt regulator 218 may be, for example but is not limited to, a National Semiconductor LMV431 low-voltage (1.24 V) adjustable precision shunt regulator, and the depletion-mode FET 210 may be, for example but is not limited to, an IXYS high voltage MOSFET IXTP 01N100D having a maximum Vdss of 1000 volts DC and a maximum drain to source current of 100 ma. The input voltage range for operation of the universal-voltage discrete input circuit 200 may be from less than 7 volts to the maximum voltage rating of the depletion-mode FET 210, e.g., 1000 volts DC for the MOSFET IXTP 01N100D device. The current drawn from the input voltage source remains at a constant low value (substantially the same value as the current through the isolated input of the isolation circuit 108). Resistance values may be, for example but are not limited to, resistor 212=10,000 ohms, resistor 214=1000 ohms and resistor 216=430 to 910 ohms.

Figure 3:
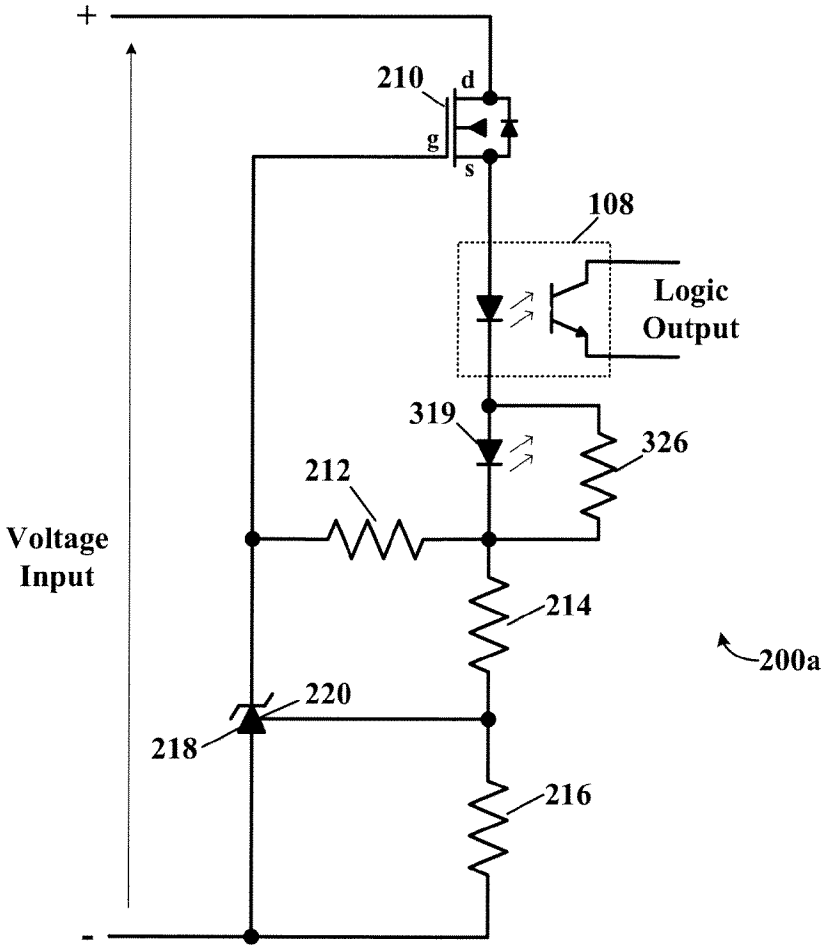
FIG. 3 illustrates a schematic diagram of the universal-voltage discrete input circuit of FIG. 2 with the addition of an input status indicator, according to another specific example embodiment of this disclosure.

Referring to FIG. 3, depicted is a schematic diagram of the universal-voltage discrete input circuit of FIG. 2 with the addition of a input status indicator, according to another specific example embodiment of this disclosure. The universal-voltage discrete input circuit, generally represented by the numeral 200*a*, functions substantially the same way as the universal-voltage discrete input circuit 200 of FIG. 2, discussed more fully hereinabove, with the addition of an input status indicator 319, e.g., an LED, relay coil, audible alarm, etc. Whenever a voltage input of at least, for example but not limited to, 7 volts is applied the input status indicator 319 will actuate (e.g., light), indicating the presence of an input voltage. When there is substantially no input voltage present, the input status indicator 319 will be off (e.g., dark) and the isolated output of the isolation circuit 108 will be off (e.g., open-high resistance between a transistor emitter and collector thereof or relay contact). The input status indicator 319 is operational whether the logic circuit coupled to the isolated output side of the isolation circuit is active or not. This enables the apparatus shown in FIG. 3 to be functional during installation and start-up activities regardless of whether the control/instrumentation side of the logic circuit is powered up or even yet installed. Resistor 326 may optionally be used to bypass current around the status indicator 319 so that more current may flow through the isolated input of the isolation circuit 108 without exceeding the current rating of the status indicator 319.

Figure 4:
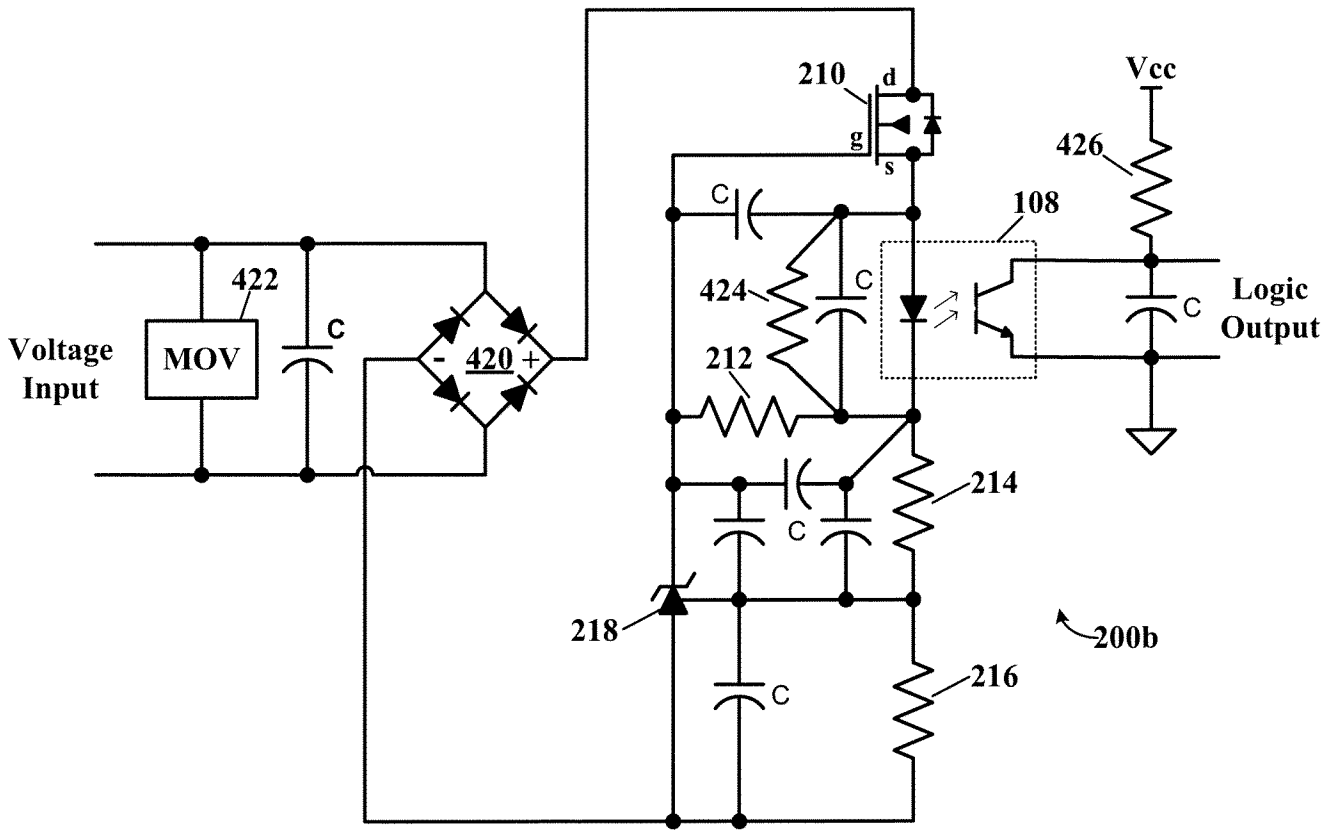
FIG. 4 illustrates a more detailed schematic diagram of the universal-voltage discrete input circuit of FIG. 2 showing input and output auxiliary circuits, and bypass and signal smoothing capacitors, according to the specific example embodiments of this disclosure.

Referring to FIG. 4, depicted is a more detailed schematic diagram of the universal-voltage discrete input circuit of FIG. 2 showing input and output auxiliary circuits, and bypass and signal smoothing capacitors, according to the specific example embodiments of this disclosure. The universal-voltage discrete input circuit, generally represented by the numeral 200*b*, functions substantially the same way as the universal-voltage discrete input circuit 200 of FIG. 2, discussed more fully hereinabove, with the addition of a full wave bridge rectifier 420 that allows the voltage input to be AC or +/−DC, a surge/transient suppressor 422, a pull-up resistor 426 and a current bypass (shunt) resistor 424. Capacitors, C, are shown throughout this circuit implementation and may be used for noise/transient suppression, switching stability and AC waveform smoothing. One having ordinary skill in analog electronic circuit design and the benefit of this disclosure would readily understand the purposes and appropriate values for the capacitors shown in FIG. 4.

The pull-up resistor 426 on the isolated output of the isolation circuit 108 is used to generate a discrete digital logic signal (on or off). When current is flowing through the isolated input of the isolation circuit 108, the isolated output thereof is conducting (on) and a logic LOW is generated. When no current is flowing through the isolated input of the isolation circuit 108, the isolated output thereof is not conducting (off) and a logic high to Vcc is generated through the pull-up resistor 426. Zero-crossing glitches of low-amplitude AC signals may be filtered out with a suitable capacitor across the isolated output of the isolation circuit 108, as shown in FIG. 4. The digital logic circuit input is isolated from the input voltage signal up to the voltage isolation rating of the isolation circuit 108, e.g., 5000 volts DC. The shunt resistor 424 may be selected to allow more current to pass through the depletion-mode FET 210 then through the isolated input of the isolation circuit 108.

Although specific example embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

We claim:

1. An apparatus for controlling a low voltage digital circuit with a voltage source having a wide range of voltage values, said apparatus comprising:

a depletion-mode field effect transistor (FET) having a drain, gate and source, wherein the drain thereof is adapted for coupling to the voltage source;

an adjustable shunt regulator having an anode, cathode and reference input;

a resistor network for providing a reference voltage to the reference input of the adjustable shunt regulator, wherein the reference voltage is representative of a current through the resistor network; and an isolation circuit having an isolated input and an isolated output;

wherein the isolated input of the isolation circuit is coupled between the source of the depletion-mode FET and the resistor network, the cathode of the adjustable shunt regulator is coupled to the gate of the depletion-mode FET, and the anode of the adjustable shunt regulator and the resistor network are coupled to a common of the voltage source;

whereby the adjustable shunt regulator causes the depletion-mode FET to maintain a substantially constant current drawn from the voltage source over a wide range of input voltages therefrom.

2. The apparatus according to claim 1, further comprising a full wave bridge rectifier between the voltage source, and the drain of the depletion-mode FET and the anode of the adjustable shunt regulator, wherein the input voltage from the voltage source can be alternating current (AC), positive direct current (DC) and negative DC.

3. The apparatus according to claim 1, wherein the wide input voltage range of the voltage source is from less than about seven (7) volts to about 1000 volts.

4. The apparatus according to claim 1, further comprising an indication device for indicating when a voltage from the voltage source is present at the drain of the depletion-mode FET.

5. The apparatus according to claim 4, wherein the indication device is a light emitting diode (LED).

6. The apparatus according to claim 1, wherein the isolation circuit is an optocoupler having a light emitting diode (LED) for the isolated input and a phototransistor for the isolated output.

7. The apparatus according to claim 6, further comprising a pull-up resistor from the isolated output of the isolation circuit to a digital circuit voltage, wherein the pull-up resistor provides a logic high when the phototransistor is off.

8. The apparatus according to claim 1, wherein the isolation circuit is an electromechanical relay having a coil for the isolated input and a contact for the isolated output.

9. The apparatus according to claim 1, wherein the isolation circuit is a transformer coupled digital isolator.

10. The apparatus according to claim 1, wherein when the input voltage from the voltage source is of a sufficient value the isolated output of the isolation circuit turns on, otherwise the isolated output is off.

11. An apparatus for controlling a low voltage digital circuit with a voltage source having a wide range of voltage values, said apparatus comprising:

a full wave bridge rectifier coupled to a voltage source;

a depletion-mode field effect transistor (FET) having a drain, gate and source, wherein the drain thereof is adapted for coupling to the full wave bridge rectifier;

an adjustable shunt regulator having an anode, cathode and reference input;

a resistor network for providing a reference voltage to the reference input of the adjustable shunt regulator, wherein the reference voltage is representative of a current through the resistor network; and an isolation circuit having an isolated input and an isolated output;

wherein the isolated input of the isolation circuit is coupled between the source of the depletion-mode FET and the resistor network, the cathode of the adjustable shunt regulator is coupled to the gate of the depletion-mode FET, and the anode of the adjustable shunt regulator and the resistor network are coupled to the full wave bridge rectifier;

whereby the adjustable shunt regulator causes the depletion-mode FET to maintain a substantially constant current drawn over a wide range of input voltages from the voltage source.

12. The apparatus according to claim 11, wherein the wide input voltage range of the voltage source is from less than about seven (7) volts to about 1000 volts.

13. The apparatus according to claim 11, further comprising an indication device for indicating when a voltage from the full wave bridge rectifier is present at the drain of the depletion-mode FET.

14. The apparatus according to claim 13, wherein the indication device is a light emitting diode (LED).

15. The apparatus according to claim 11, wherein the isolation circuit is an optocoupler having a light emitting diode (LED) for the isolated input and a phototransistor for the isolated output.

16. The apparatus according to claim 15, further comprising a pull-up resistor from the isolated output of the isolation circuit to a digital circuit voltage, wherein the pull-up resistor provides a logic high when the phototransistor is off.

17. The apparatus according to claim 11, wherein the isolation circuit is an electromechanical relay having a coil for the isolated input and a contact for the isolated output.

18. The apparatus according to claim 11, wherein the isolation circuit is a transformer coupled digital isolator.

19. The apparatus according to claim 11, wherein when the input voltage from the voltage source is of a sufficient value the isolated output of the isolation circuit turns on, otherwise the isolated output is off.

20. A method of controlling a low voltage digital circuit with a voltage source having a wide range of voltage values, said method comprising the steps of:

providing a depletion-mode field effect transistor (FET) having a drain, gate and source, wherein the drain thereof is adapted for coupling to the voltage source;

providing an adjustable shunt regulator having an anode, cathode and reference input;

providing a reference voltage from a resistor network to the reference input of the adjustable shunt regulator, wherein the reference voltage represents a current through the resistor network;

providing an isolation circuit having an isolated input and an isolated output;

coupling the isolated input of the isolation circuit between the source of the depletion-mode FET and the resistor network;

coupling the cathode of the adjustable shunt regulator to the gate of the depletion-mode FET;

coupling the anode of the adjustable shunt regulator and the resistor network to a common of the voltage source; and maintaining a substantially constant current drawn from the voltage source over a wide range of input voltages therefrom by controlling a gate voltage of the depletion-mode FET with the adjustable shunt regulator.

* * * * *